US009228355B2

(12) United States Patent
Edwards et al.

(10) Patent No.: US 9,228,355 B2
(45) Date of Patent: Jan. 5, 2016

(54) ABOVE-DECK ROOF VENTING ARTICLE

(71) Applicant: 3M INNOVATIVE PROPERTIES COMPANY, St. Paul, MN (US)

(72) Inventors: John Scott Edwards, Hudson, WI (US); Frank William Klink, Oak Park Heights, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 206 days.

(21) Appl. No.: 13/666,123

(22) Filed: Nov. 1, 2012

(65) Prior Publication Data

US 2014/0115980 A1 May 1, 2014

(51) Int. Cl.
*E04D 13/17* (2006.01)
*E04D 13/152* (2006.01)

(52) U.S. Cl.
CPC ..... *E04D 13/17* (2013.01); *E04D 13/152* (2013.01)

(58) Field of Classification Search
CPC ..... E04D 13/17; E04D 13/178; E04D 13/174; E04D 13/152; E04D 13/176; F24F 7/02; F24F 11/0001; F24F 11/0012; F24F 11/0015
USPC ..... 52/199, 95
See application file for complete search history.

(56) References Cited

U.S. PATENT DOCUMENTS 1,259,914 A * 3/1918 Seward et al. ..... 52/553
2,318,820 A * 5/1943 Voigt et al. ..... 52/302.3
3,006,113 A * 10/1961 Barnes et al. ..... 52/91.3
3,058,265 A * 10/1962 Lapsensohn ..... 52/536
3,368,473 A * 2/1968 Sohda et al. ..... 454/185
3,528,543 A * 9/1970 Robinsky ..... 428/178
3,625,134 A * 12/1971 Smith ..... 454/365
3,660,955 A * 5/1972 Simon ..... 52/420
3,686,813 A * 8/1972 Breitwieser et al. ..... 52/302.3
3,732,656 A * 5/1973 Robinsky ..... 52/108
3,797,180 A * 3/1974 Grange ..... 52/95
3,949,732 A * 4/1976 Reines ..... 126/597

(Continued)

FOREIGN PATENT DOCUMENTS

EP 2019172 1/2009
GB 2 262 295 6/1993
WO WO 2012/033816 3/2012

OTHER PUBLICATIONS

International Application PCT/US2013/065170 Search Report dated Jan. 16, 2014.

*Primary Examiner* — James Ference
(74) *Attorney, Agent, or Firm* — Daniel J. Iden

(57) ABSTRACT

A building construction assembly for installation on a roof deck including a base layer and a channel structure coupled to the base layer and defining a plurality of channels. In an embodiment, the plurality of channels include a first airflow channel and second airflow channel extending in parallel through the channel structure. The plurality of channels further includes a venting channel between the first and second airflow channels and the base layer. The channel structure defines one or more apertures between the venting channel and each of the first and second airflow channels configured to allow airflow from the first and second airflow channels into the venting channel. The base layer defines one or more exit orifices in airflow communication with the venting channel and configured such that air in the venting channel exits the building construction assembly through the one or more exit orifices.

24 Claims, 14 Drawing Sheets

(56) References Cited

U.S. PATENT DOCUMENTS

| | | | | | |
|---|---|---|---|---|---|
| 4,254,598 | A * | 3/1981 | Rugroden | 52/199 |
| 4,280,399 | A * | 7/1981 | Cunning | 454/365 |
| 4,296,798 | A * | 10/1981 | Schramm | 165/56 |
| 4,393,859 | A * | 7/1983 | Marossy et al. | 126/586 |
| 4,406,095 | A * | 9/1983 | Slavik | 52/95 |
| 4,428,360 | A * | 1/1984 | Cohen | 126/622 |
| 4,660,463 | A * | 4/1987 | Bottomore et al. | 454/260 |
| 4,677,903 | A * | 7/1987 | Mathews, III | 454/185 |
| 4,903,445 | A * | 2/1990 | Mankowski | 52/199 |
| 5,060,444 | A * | 10/1991 | Paquette | 52/535 |
| 5,172,527 | A * | 12/1992 | Ault | 52/145 |
| 5,259,157 | A * | 11/1993 | Ault | 52/145 |
| 5,295,339 | A * | 3/1994 | Manner | 52/518 |
| 5,549,513 | A * | 8/1996 | Thomas et al. | 454/365 |
| 5,551,204 | A * | 9/1996 | Mayrand | 52/795.1 |
| 5,600,928 | A * | 2/1997 | Hess et al. | 52/309.4 |
| 5,630,752 | A * | 5/1997 | Gubash | 454/366 |
| 5,766,071 | A * | 6/1998 | Kirkwood | 454/185 |
| 5,799,461 | A * | 9/1998 | Dittemore | 52/588.1 |
| 6,061,973 | A * | 5/2000 | Accardi et al. | 52/90.1 |
| 6,061,978 | A * | 5/2000 | Dinwoodie et al. | 52/173.3 |
| 6,233,887 | B1 * | 5/2001 | Smith | 52/199 |
| 6,301,842 | B1 * | 10/2001 | Chaney et al. | 52/177 |
| 6,347,991 | B1 * | 2/2002 | Bogrett et al. | 454/260 |
| 6,357,185 | B1 * | 3/2002 | Obermeyer et al. | 52/95 |
| 6,390,914 | B1 * | 5/2002 | O'Hagin et al. | 454/366 |
| 6,487,826 | B1 * | 12/2002 | McCorsley et al. | 52/408 |
| 6,598,356 | B1 * | 7/2003 | Sells | 52/90.1 |
| 6,955,012 | B2 * | 10/2005 | Suzuki | 52/198 |
| 7,117,649 | B2 * | 10/2006 | Morris et al. | 52/302.3 |
| 7,146,920 | B1 * | 12/2006 | Ryan et al. | 114/85 |
| 7,231,744 | B2 | 6/2007 | Cooper | |
| 7,240,804 | B2 * | 7/2007 | King et al. | 220/218 |
| 7,458,189 | B2 * | 12/2008 | Pollack | 52/302.1 |
| 7,540,118 | B2 * | 6/2009 | Jensen | 52/232 |
| 7,565,775 | B2 | 7/2009 | Cooper | |
| 7,654,051 | B2 * | 2/2010 | Pollack | 52/302.1 |
| 7,758,408 | B2 * | 7/2010 | Hagentoft | 454/256 |
| 8,028,475 | B2 * | 10/2011 | Sigmund et al. | 52/95 |
| 8,157,628 | B2 * | 4/2012 | Villela et al. | 454/365 |
| 8,281,522 | B1 * | 10/2012 | Hawryshko et al. | 52/95 |
| 8,322,089 | B2 * | 12/2012 | Railkar et al. | 52/198 |
| 8,826,603 | B2 * | 9/2014 | Shield et al. | 52/95 |
| 2002/0038530 | A1 * | 4/2002 | Clark | 52/171.3 |
| 2003/0177705 | A1 * | 9/2003 | Forbis et al. | 52/3 |
| 2004/0088928 | A1 * | 5/2004 | Headrick et al. | 52/98 |
| 2004/0088932 | A1 * | 5/2004 | Headrick | 52/198 |
| 2004/0216397 | A1 * | 11/2004 | Sigmund | 52/95 |
| 2004/0237428 | A1 * | 12/2004 | Headrick et al. | 52/198 |
| 2005/0054284 | A1 * | 3/2005 | Ciepliski et al. | 454/365 |
| 2005/0072072 | A1 * | 4/2005 | Duncan et al. | 52/198 |
| 2005/0178076 | A1 * | 8/2005 | Rasmussen et al. | 52/96 |
| 2006/0005491 | A1 * | 1/2006 | Cooper et al. | 52/302.1 |
| 2007/0051069 | A1 * | 3/2007 | Grimes | 52/782.1 |
| 2007/0072541 | A1 * | 3/2007 | Daniels et al. | 454/365 |
| 2007/0151176 | A1 * | 7/2007 | Mumaw et al. | 52/198 |
| 2007/0151177 | A1 * | 7/2007 | Mumaw et al. | 52/198 |
| 2007/0207725 | A1 * | 9/2007 | O'Hagin | 454/365 |
| 2007/0234650 | A1 * | 10/2007 | Coulton et al. | 52/95 |
| 2007/0243820 | A1 * | 10/2007 | O'Hagin | 454/365 |
| 2008/0009867 | A1 * | 1/2008 | Banouskou et al. | 606/61 |
| 2008/0028704 | A1 * | 2/2008 | Cooper et al. | 52/302.1 |
| 2008/0098674 | A1 * | 5/2008 | Daniels | 52/199 |
| 2008/0113612 | A1 * | 5/2008 | Chich et al. | 454/341 |
| 2008/0236058 | A1 * | 10/2008 | Antonie | 52/90.1 |
| 2008/0245010 | A1 * | 10/2008 | Pollack | 52/404.3 |
| 2008/0308093 | A1 * | 12/2008 | Gianasso et al. | 126/622 |
| 2009/0113817 | A1 * | 5/2009 | Austin et al. | 52/95 |
| 2009/0203308 | A1 | 8/2009 | O'Hagin | |
| 2009/0286463 | A1 * | 11/2009 | Daniels | 454/366 |
| 2009/0311959 | A1 * | 12/2009 | Shepherd | 454/366 |
| 2010/0229498 | A1 * | 9/2010 | Pollack | 52/741.4 |
| 2010/0330898 | A1 * | 12/2010 | Daniels | 454/365 |
| 2011/0030287 | A1 * | 2/2011 | Moore | 52/95 |
| 2011/0185656 | A1 * | 8/2011 | Klein | 52/232 |
| 2012/0047844 | A1 * | 3/2012 | Walker | 52/741.4 |
| 2012/0073216 | A1 * | 3/2012 | Daniels | 52/95 |
| 2012/0090266 | A1 * | 4/2012 | McCary | 52/794.1 |
| 2013/0263530 | A1 * | 10/2013 | Shiao et al. | 52/95 |
| 2014/0115980 | A1 * | 5/2014 | Edwards et al. | 52/173.3 |

* cited by examiner

ABOVE-DECK ROOF VENTING ARTICLE

TECHNICAL FIELD

The present disclosure relates to building materials. More specifically, the present disclosure relates to an above-deck roofing article having a plurality of airflow paths therein.

BACKGROUND

It can be desirable to use construction articles that provide energy conservation advantages for buildings and housing structures. Absorbed solar energy increases cooling energy costs in buildings, particularly in warm southern climates, which can receive a high incidence of solar radiation. An absorber of solar energy is building roofs. It is not uncommon for the air temperature within an attic or unconditioned space that is adjacent to or under a roof, to exceed the ambient air temperature by 40° F. (about 22.2° C.) or more, due in part to absorption of solar energy by the roof or conduction of the solar energy through the roof. This can lead to significant energy costs for cooling the interior spaces of a building to a comfortable living temperature.

SUMMARY

The present disclosure relates to a building construction assembly for installation on a roof deck including a base layer and a channel structure coupled to the base layer and defining a plurality of channels. The plurality of channels include a first airflow channel and second airflow channel extending in parallel through the channel structure. The plurality of channels further includes a venting channel between the first and second airflow channels and the base layer. The channel structure defines one or more apertures between the venting channel and each of the first and second airflow channels configured to allow airflow from the first and second airflow channels into the venting channel. The base layer defines one or more exit orifices in airflow communication with the venting channel and configured such that air in the venting channel exits the building construction assembly through the one or more exit orifices.

In various exemplary embodiments, the building construction assembly further includes one or more exit channels each in airflow communication with one of the one or more exit orifices. In some embodiments, a shingle assembly disposed on the base layer on a side opposite the channel assembly defines the one or more exit channels. A radiant barrier film may be disposed on one or more surfaces of the channel structure. In some embodiments, the building construction assembly is fastenable to the roof deck with a plurality of fasteners extending through at least a portion of the channel structure and into the roof deck. In other embodiments, the building construction assembly is fastenable to the roof deck with an expandable adhesive. One or more additional layers, such as shingles, may be fastenable to the base layer on a side opposite the channel structure via fasteners extending through the additional layers and building construction assembly and into the expandable adhesive. In some embodiments, the building construction assembly has a weight of between about 0.50 lbs/ft$^2$ and about 1.25 lbs/ft$^2$ and/or a structural load capacity of at least 200 pounds per 4 inch by 4 inch area. In some embodiments, the base layer is flexible and the channel structure is configured such that the building construction assembly is transportable in roll form. The channel structure may further define one or more roof ventilation orifices on a side of the channel structure opposite base layer that are each configured for airflow communication with an unconditioned space below the roof deck.

The present disclosure further provides a system for a roof that includes a plurality of building construction assemblies. Each base assembly includes a base layer and a channel structure coupled to the base layer and defining a plurality of channels. The plurality of channels include a first airflow channel and second airflow channel extending in parallel through the channel structure. The plurality of channels further includes a venting channel between the first and second airflow channels and the base layer. The channel structure defines one or more apertures between the venting channel and each of the first and second airflow channels configured to allow airflow from the first and second airflow channels into the venting channel. The base layer defines one or more exit orifices in airflow communication with the venting channel and configured such that air in the venting channel exits the building construction assembly through the one or more exit orifices. The plurality of building construction assemblies are adjacently arranged on a roof deck such that the plurality of channels in the adjacently arranged building construction assemblies extend from a soffit region of the roof to a peak of the roof.

In various exemplary embodiments, each building construction assembly further includes one or more exit channels each in airflow communication with one of the one or more exit orifices. In some embodiments, a shingle assembly disposed on the base layer on a side opposite the channel assembly defines the one or more exit channels. A radiant barrier film may be disposed on one or more surfaces of the channel structure of each of the building construction assemblies. In some embodiments, each building construction assembly is fastenable to the roof deck with a plurality of fasteners extending through at least a portion of the channel structure and into the roof deck. In other embodiments, each building construction assembly is fastenable to the roof deck with an expandable adhesive, and one or more additional layers are fastenable to the base layer of each building construction assembly on a side opposite the channel structure via fasteners extending through the additional layers and building construction assembly and into the expandable adhesive. In some embodiments, the channel structure of each building construction assembly defines one or more roof ventilation orifices on a side of the channel structure opposite base layer. The one or more roof ventilation orifices are each configured for airflow communication with an unconditioned space below the roof deck. Shingles and/or an optical layer may be coupled to the base layer of each building construction assembly on a side opposite the channel structure. In some embodiments, a collection manifold may be in airflow communication with the plurality of channels for solar harvesting of low grade heat. The system may also include a solar thermal unit for storage or transfer of the low grade heat.

In further exemplary embodiments, a building construction article includes a body. A first airflow channel is defined in the body and includes an inlet through which outside air can enter the first airflow channel. A second airflow channel is also defined in the body and extends in parallel with the first airflow channel through the body. The second airflow channel also includes an inlet through which outside air can enter the second airflow channel. A venting channel is further defined in the body between the first and second airflow channels. The body defines one or more apertures between the venting channel and each of the first and second airflow channels. The one or more apertures configured to allow airflow from the first and second airflow channels into the venting channel. The body further defines one or more exit orifices in airflow communication with the venting channel and configured such that air in the venting channel exits the building construction article through the one or more exit orifices.

In further exemplary embodiments, the body further defines one or more exit channels each in airflow communication with one of the one or more exit orifices. In other embodiments, a shingle assembly is coupled to the body and defines one or more exit channels each in airflow communication with one of the one or more exit orifices. A radiant barrier film may be disposed on one or more surfaces of the body. In an implementation, a roofing system including a plurality of building construction articles according to this aspect are adjacently arranged such that first and second airflow channels of the adjacently arranged building construction articles extend from a roof soffit region to a roof peak.

The above summary of the present invention is not intended to describe each disclosed embodiment or every implementation of the present invention. While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
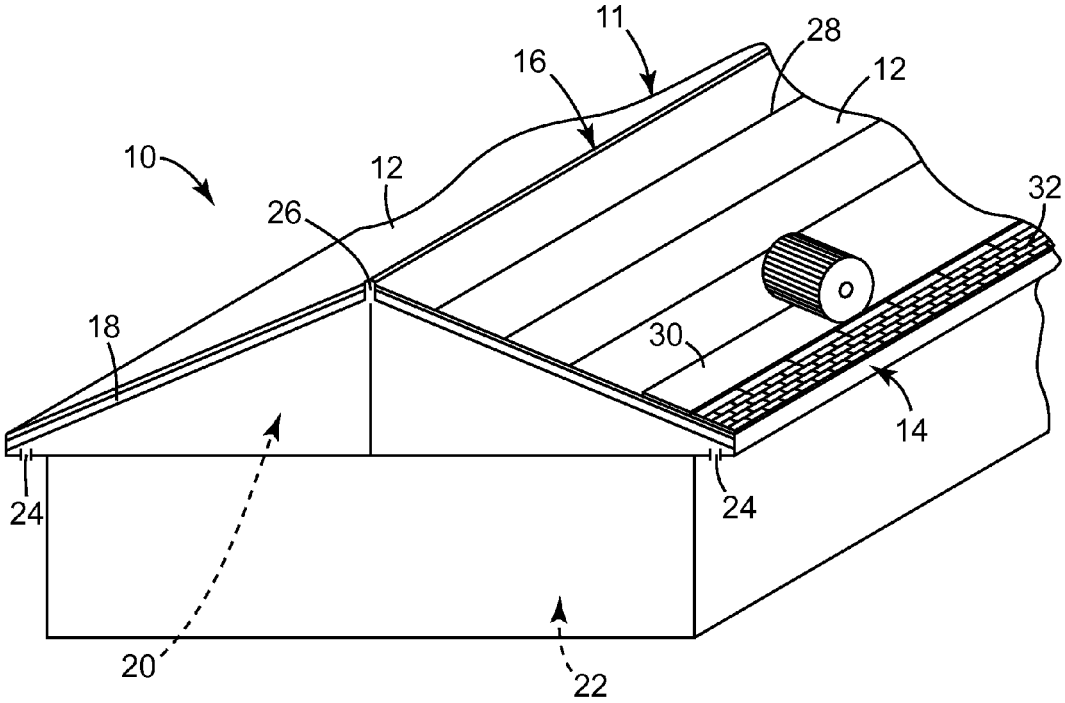
FIG. 1 is a schematic perspective view of a building illustrating a roofing system according to the present disclosure.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

When in the following terms such as "upper" and "lower," "top" and "bottom," "right" and "left," or similar relative expressions are used, these terms only refer to the appended figures and not necessarily to an actual situation of use.

The present disclosure broadly relates to a roofing article with an airflow path for use in an above-deck roof ventilation system, and methods of installing such roofing articles.

Various exemplary embodiments of the disclosure will now be described with particular reference to the Drawings. Embodiments of the present disclosure may take on various modifications and alterations without departing from the spirit and scope of the disclosure. Accordingly, it is to be understood that the embodiments of the present disclosure are not to be limited to the following described exemplary embodiments, but is to be controlled by the limitations set forth in the claims and any equivalents thereof.

Thus, reference throughout this specification to "one embodiment," "embodiments," "one or more embodiments" or "an embodiment," whether or not including the term "exemplary" preceding the term "embodiment," means that a particular feature, structure, material, or characteristic described in connection with the embodiment is included in at least one embodiment of the exemplary embodiments of the present disclosure. Therefore, the appearances of the phrases such as "in one or more embodiments," "in embodiments," "in some embodiments," "in one embodiment," or "in an embodiment" in various places throughout this specification are not necessarily referring to the same embodiment of the exemplary embodiments of the present disclosure. Furthermore, the particular features, structures, materials, or characteristics may be combined in any suitable manner in one or more embodiments.

FIG. 1 is a schematic perspective view of a building 10 illustrating a roofing system according to the present disclosure. The building 10 includes a roof 11 including one or more roof portions 12 each extending between a soffit 14 and a roof peak or ridge 16. The roof 11 includes a roof board or deck 18 that covers an unconditioned space or attic 20. The attic 20 can serve as a buffer to a living space 22 below the attic 20. The roof 11 can include vents 24 on the soffit 14 and/or one or more ridge vents 26.

In the roofing system according to the present disclosure, an underlayer 28 may be laid on the roof deck 18 to provide waterproofing or thermal insulation between the roof deck 18 and subsequent layers. In some embodiments, underlayer 28 is a roof felt or tar paper that is adhered or mechanically secured to the roof deck 18. Alternatively, the underlayer 28 may include a polymeric material, such as polypropylene. An example underlayer 28 is sold under the trade name TITANIUM UDL-50 from InterWrap, Inc. of Mission, British Columbia. The underlayer 28 may also include other types of layers, including optical layers such as infrared reflective layers. For example, suitable infrared reflective layers for use in underlayer 28 include the infrared reflective films disclosed in U.S. Pat. Nos. 6,049,419, 6,797,396, 6,927,900, and U.S. Patent App. Pub. Nos. 2001/0009714 and 2005/0243425, the disclosures of which are each incorporated herein by reference in its entirety. While shown laid on the roof deck 18, the underlayer 28 may alternatively be a rigid, optionally breathable, layer attached to the underside of the building construction assemblies as described herein, such that the underlayer 28 and the building construction assemblies are installed as a single unit. Additional layers may be used in conjunction with the underlayer 28 to provide additional benefits, such as a radiant barrier (e.g., ATTIC FOIL) disposed on surfaces within the attic 20.

A building construction article or assembly 30 according to the present disclosure is then laid on the underlayer 28. The configurations and characteristics of the building construction assembly 30 will be described in more detail below. In some embodiments, the building construction assembly 30 is provided and transported in roll form, and the building construction assembly 30 is rolled onto the underlayer 28. Thus, the building construction assembly 30 is formed, at least in part, of flexible materials or is otherwise able to flex to be configured in a roll form. In one exemplary implementation, the building construction assembly 30 is provided in a roll having dimensions of 3 feet (0.914 m) by 30 feet (9.14 m), although rolls of any other dimensions are possible. Alternatively, the building construction assembly 30 may be provided in sheet form. In one exemplary implementation, the building construction assembly 30 is provided in a sheet having dimensions of 4 feet (1.22 m) by 8 feet (2.44 m), although sheets of any other dimensions are possible.

To install, a plurality of the building construction assembly 30 are positioned adjacently to each other to cover the underlayer 28. As will be described in more detail herein, each building construction assembly 30 includes a plurality of channels that extend in parallel between the ends of the building construction assembly 30. When installed in the roofing system of the present disclosure, the adjacently positioned building construction assemblies 30 provide a plurality of channels that extend from the soffit 14 to the peak 16 of the roof 11. In some embodiments, the channels are in airflow communication with the ridge vent 26. The channels take in air via inlets on the building construction assemblies 30 proximate the soffit 14, which flows through the channels to the peak 16 due to natural air buoyancy and/or forced air mechanisms (not shown). As a result, heat from the thermal solar load on the roof 11 can be purged from the roof system and/or harvested for use within the building 10. While the embodiments of the building construction assemblies 30 disclosed herein are described with respect to use on a roof, the building construction assemblies 30 may alternatively be configured for use in other portions of the building 10, such as vertical and sloped walls.

In some embodiments, one or more additional layers or a protective covering 32 may be secured to the top side of the plurality of building construction assemblies 30. For example, in some embodiments the one or more additional layers 32 can include asphalt shingles, concrete, slate, or clay tiles, metal tile or shingles, standing seam metal roofs, or other roof protective coverings. In some embodiments, the one or more additional layers 32 define one or more exit channels (not shown in FIG. 1) that facilitate venting or purging of air within the building construction assemblies 30.

The one or more additional layers 32 may also include one or more optical layers, such as a UV reflective layer or an IR reflective layer, secured to the top of the building construction assemblies 30. The optical layer(s) may be configured to resemble conventional protective coverings (e.g., shingles, etc.), such that the one or more optical layers form the top layer on the roofing system. Alternatively, the optical layer(s) may be disposed between the building construction assemblies 30 and a protective covering. Examples of optical layers suitable for use in the roofing system of the present disclosure are described in, for example, PCT App. Pub. WO 2011/062836, entitled "Multi-Layer Optical Films," and U.S. Patent App. Pub. No. 2011/0255155, entitled "Fluoropolymeric Multilayer Optical Film and Methods of Making and Using the Same," each of which is incorporated by reference in its entirety for all purposes.

Other materials, configurations, and characteristics relevant to the roofing system of the present disclosure is also described in PCT App. Pub. WO 2012/033816, entitled "Above-Deck Roof Venting Article," which is incorporated by reference in its entirety for all purposes.

Figure 2A:
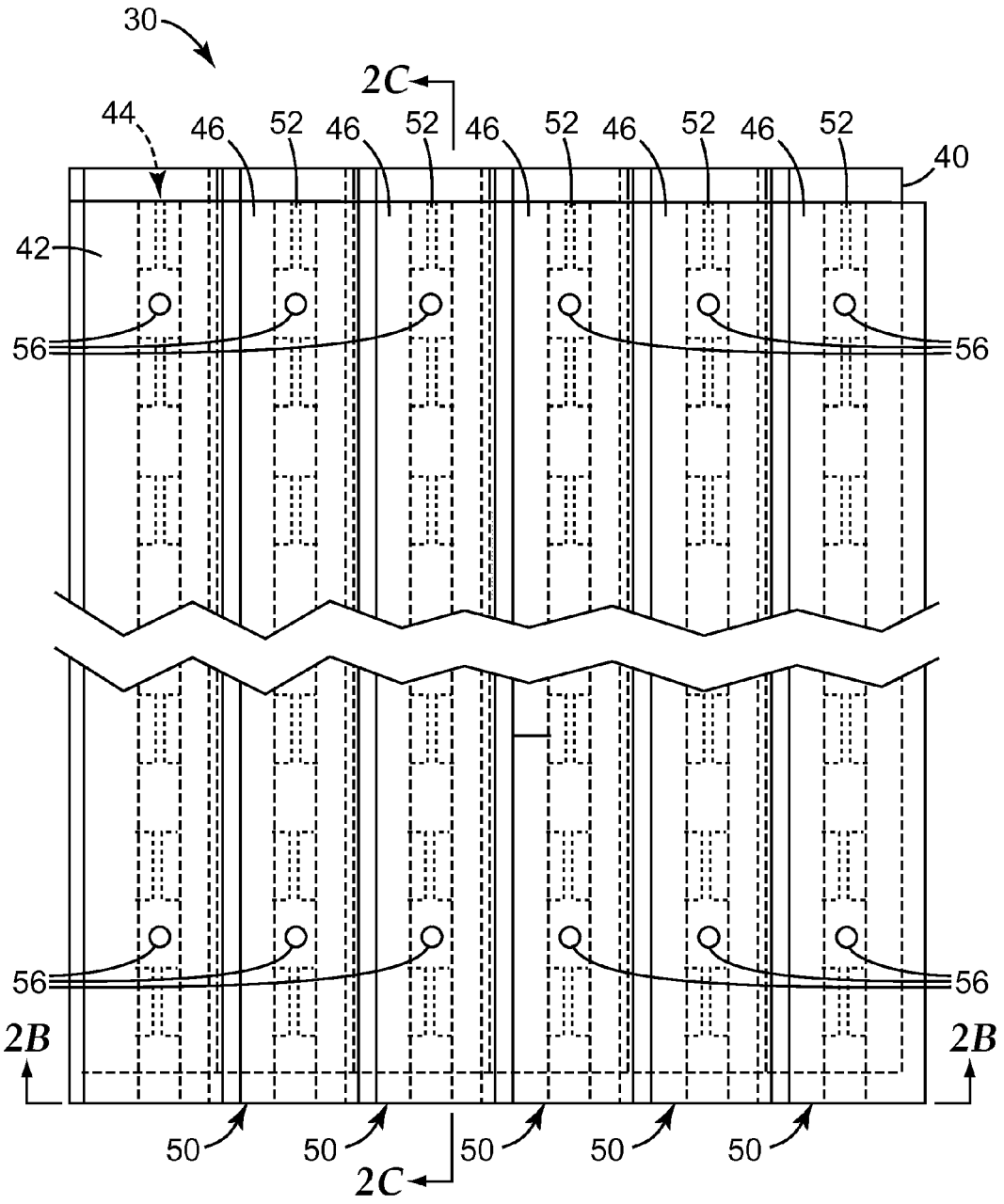
FIG. 2A is a schematic top view of a building construction assembly according to an embodiment of the present disclosure.
Figure 2B:
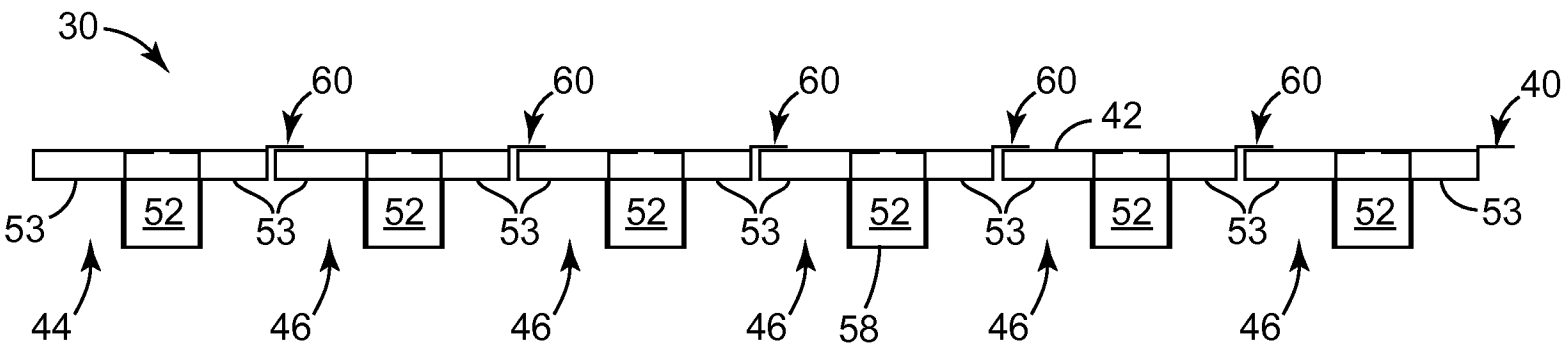
FIG. 2B is a schematic end view of the building construction assembly of FIG. 2A along line 2B-2B.
Figure 2C:
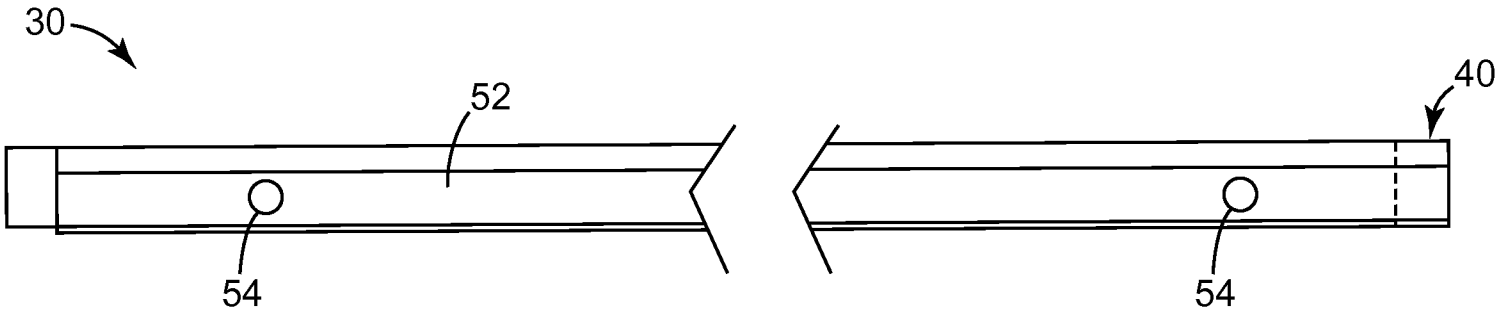
FIG. 2C is a schematic cross-sectional view of the building construction assembly of FIG. 2A along line 2C-2C.

FIG. 2A is a schematic top view of a building construction assembly 30 according to an embodiment of the present disclosure. FIG. 2B is schematic end view of the building construction assembly 30 taken along line 2B-2B in FIG. 2A, and FIG. 2C is a schematic cross-sectional view of the building construction assembly 30 taken along line 2C-2C in FIG. 2A. The building construction assembly 30 includes a body 40 that includes a base layer 42 and a channel structure 44 coupled to the base layer 42 that may be integral or non-integral to channel structure 44. The channel structure 44 is shown in phantom in FIG. 2A.

The channel structure 44 includes a plurality of airflow channels 46 that extend in parallel from a first end 48 to a second end 49 of the building construction assembly 30. The plurality of channels 46 are configured to receive outside air through inlets 50 at the first end 48. The channel structure 44 further includes a plurality of venting channels 52 that are disposed between the airflow channels 46 and the base layer 42. A plurality of structural channels 53 define the top surface of the airflow channels 46 and extend from the venting channels 52 and provide structural integrity for the building construction assembly 30. The structural channels 53 provide increased structural integrity to the building construction assembly 30 and may provide additional channels for airflow along the roof. The channel structure 44 further includes one or more apertures 54 that provide airflow communication between the airflow channels 46 and the venting channels 52. In some embodiments, airflow communication is provided through apertures between the structural channels 53 and venting channels 52. Alternatively, the structural channels 53 can share a common airspace with adjacent venting channels 52 (i.e., no walls between the structural channels 53 and adjacent venting channels 52). In some embodiments, each venting channel 52 is in airflow communication with two adjacent airflow channels 46 and structural channels 53. In some embodiments, the apertures 54 are configured to allow warmer air to flow from the airflow channels 46 and structural channels 53 into the venting channels 52. The channel structure 44 further includes a plurality of exit orifices 56 in airflow communication with the venting channels 52. The exit orifices 56 are configured to allow air in the venting channels 52 to exit the channel structure 44. The airflow through the channel structure 44 of the building construction assembly 30 will be described in more detail below with regard to FIGS. 4A and 4B.

Building construction assemblies 30 may be installed onto the roof deck 18 as described above, such that a plurality of building construction assemblies 30 are adjacently positioned to define channels that extend from the soffit 14 to the peak 16. Each building construction assembly 30 may include end portions configured to interlock, mate, overlap, or otherwise mechanically couple with end portions of adjacent building construction assemblies 30. For example, the channel structures 44 of adjacently laid building construction assemblies 30 may be configured to mechanically interact such that, when installed, the base layers 42 of the building construction assemblies 30 in the installed roofing system form a substantially uniform or planar surface.

The base layer 42 and channel structure 44 may be made of a variety of materials. In some embodiments, the base layer 42 and/or portions of the channel structure 44 are comprised of a flexible material. For example, the base layer 42 and/or channel structure may also be comprised of various high temperature and fire retardant materials, such as thermoplastic polymers, such as thermoplastic polyolefin, or fluoro or chloro polymers, such as polyvinylidene fluoride, fluorinated ethylene propylene, polytetrafluoroethylene, and polyvinyl chloride using various forming methods, such as, for example, injection molding or thermo forming, although other materials, such as polycarbonate, acrylonitrile butadiene styrene are also possible.

The base layer 42 and/or channel structure may also comprise a thermal insulation or thermal management material. For example, the thermal insulation can be formed of extruded polystyrene foam (XPS), although other materials, such as expanded polystyrene foam (EPS), polyisocyanurate, and polyurethane may also be used.

The base layer 42 and/or channel structure 44 may also comprise one or more radiant barrier film layers or low emissivity surface. For example, FIG. 2B illustrates a radiant barrier film 58 disposed on a bottom side of the channel structure 44. Radiant barrier film layers can be formed of a thin layer of a highly reflective material, such as aluminum, a silver metalized weatherable acrylic film, or of a black body. In various embodiments, the emittance of the radiant barrier film layers is less than about 0.1 (i.e. reflects at least 90% of infrared heat) as measured by ASTM E408.

The base layer 42 and/or channel structure 44 may further include an intumescent material. For example, the intumescent material may be disposed in the channels 46, 52, and/or 53. The intumescent material portion can undergo a chemical change when exposed to heat or flames to expand into a heat-insulating form. This enables containment of fire and toxic gases and inhibits flame penetration, heat transfer, and movement of toxic gases. As used throughout this disclosure, "intumescent material" refers to a substance that when applied to or incorporated within a combustible material, reduces or eliminates the tendency of the material to ignite when exposed to heat or flame, and, in general, when exposed to flame, the intumescent substance induces charring and liberates non-combustible gases to form a carbonific foam which protects the matrix, cuts off the oxygen supply, and prevents dripping. For example, such heat can be at or about 350° F. Intumescent materials can comprise an acid source, a char former, and a blowing agent. Examples of intumescent material include FIRE BARRIER WRAP ULTRA GS available from 3M Co. of Saint Paul, Minn. and REOGARD 1000 from Chemtura of Middlebury, Conn.

Additionally, a phase change material (PCM) can be included at one or more locations in the base layer 42 and/or channel structure 44. Such PCMs can undergo a solid/solid phase transition with the associated absorption and release of large amounts of heat. Like intumescent materials, PCMs can undergo a change when exposed to heat to expand into a heat-insulating form or shape. Examples of PCMs include those commercial available from PCM Products Limited or PhaseChange Energy Solutions.

In some embodiments, a layer of material can be provided within portions of the channel structure 44 to provide additional structural support to the building construction assembly 30. For example, structural material can be included in the structural channels 53 and/or portions of the venting channels 52 to provide additional cantilever support to the channel structure 44. In some embodiments, structural material may extend or otherwise be joined between adjacent structural channels 53. The structural material may include any suitable materials including foams, cellular materials, and materials exhibiting a particular pattern, such as a honeycomb structure. The structured material can include openings or cavities in which any of the materials discussed above, such as intumescent materials, PCMs, and/or thermal management material can be provided.

The channel structure 44, or portions thereof, may be formed of a rigid material to provide structural load support for layers or other loads on the top surface of the building construction assembly 30. For example, the channel structure 44 may be comprised of a metal material, such as steel or aluminum, or a rigid polymeric material.

In embodiments in which the building construction assembly 30 is transported in rolled form (FIG. 1), the building construction assembly 30 may include mechanisms that allow the base layer 42 and channel structure 44 to be rolled (e.g., around a mandrel). In some embodiments, the building construction assembly 30 includes interlocking mechanisms 60 over the airflow channels 46 that provide flexible joints to allow the building construction assembly 30 to be rolled. In some embodiments, the interlocking mechanisms 60 may be configured such that the building construction assembly 30 is rollable only with the base layer 42 on the inside of the roll. For example, in the illustrated embodiment, the structural channels 53 include walls that are configured such that vertical portions of adjacent walls abut each other (approximately center of the airflow channels 46) when the building construction assembly 30 is laid onto the roof deck 18, and in some embodiments allow airflow communication through the vertical portions of adjacent walls. The vertical portions of the walls operate to stabilize the building construction assembly 30 with the base layer 42 in a substantially planar arrangement. In some embodiments, the walls define additional airflow channels proximate the base layer 42.

In some embodiments, the building construction assembly 30 has a short-term structural load capacity of at least about 200 lbs. (90.7 kg) per 4 inch by 4 inch (10.2 cm by 10.2 cm) square area of the top surface of the building construction assembly 30 when the building construction assembly 30 is laid flat. The short-term structural load capacity is the capacity of the building construction assembly 30 to support weight (for example, of a roof installer) on the top surface of the building construction assembly 30 for a short period of time. In some embodiments, the building construction assembly 30 having a weight of between about 0.50 pounds per square foot (lbs/ft$^2$) and about 1.25 lbs/ft$^2$ (23.9-59.9 N/m$^2$) with no additional intumescent materials or PCMs included.

Figure 3:
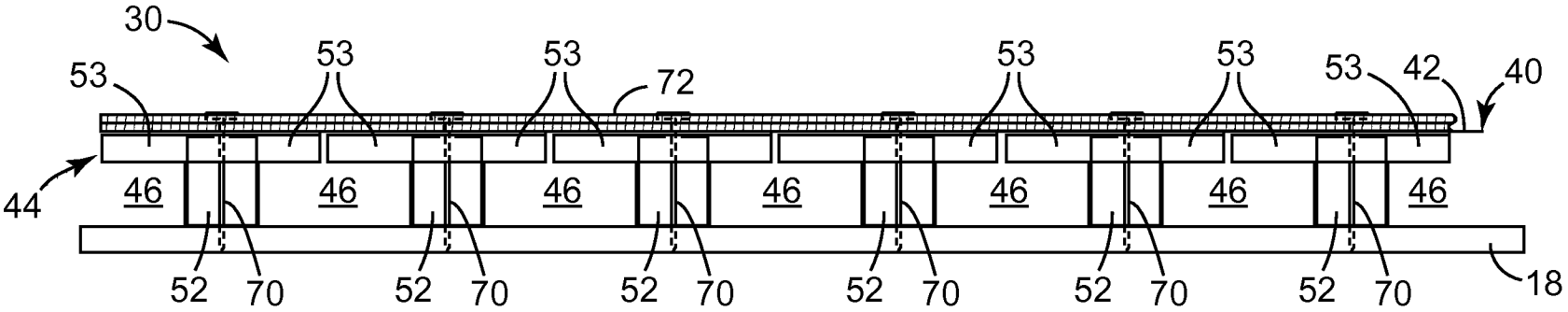
FIG. 3 is a schematic end view of an embodiment of a building construction assembly including additional layers secured thereto by fasteners.

The building construction assembly 30 may be attached to the roof deck 18 in a variety of ways. For example, FIG. 3 is a schematic end view of the building construction assembly 30 attached to the roof deck 18 with mechanical fasteners. Particularly, in the embodiment shown, the building construction assembly 30 is secured to the roof deck 18 by a plurality of nails 70 that penetrate through the base layer 42 and the channel structure 44 and into the roof deck 18. In some embodiments, the nails 70 penetrate only through portions of the venting channels 52 and into the roof deck 18. The nails 70 may comprise galvanized nails, for example. In some embodiments, the top surface of the base layer 42 can include markings indicating the locations nails 70 should be used on the building construction assembly 30.

Also shown in FIG. 3 are one or more additional or finishing layers 72 (or protective covering) secured to the top of the building construction assembly 30. As discussed above, the one or more additional layers 72 can include shingles, tiles, and/or optical layers, for example. In the embodiment shown, the one or more additional layers 72 are shingles. As is shown, the additional layers 72 are secured to the base layer 42 of the building construction assembly 30 via the nails 70 that extend through the building construction assembly 30 and secure the building construction assembly 30 to the roof deck 18. While the nails 70 are shown securing the additional layers 72 to the building construction assembly 30, and the building construction assembly 30 to the roof deck 18, alternatively separate fasteners or mechanisms may be employed to secure the additional layers 72 to the building construction assembly 30.

Figure 4A:
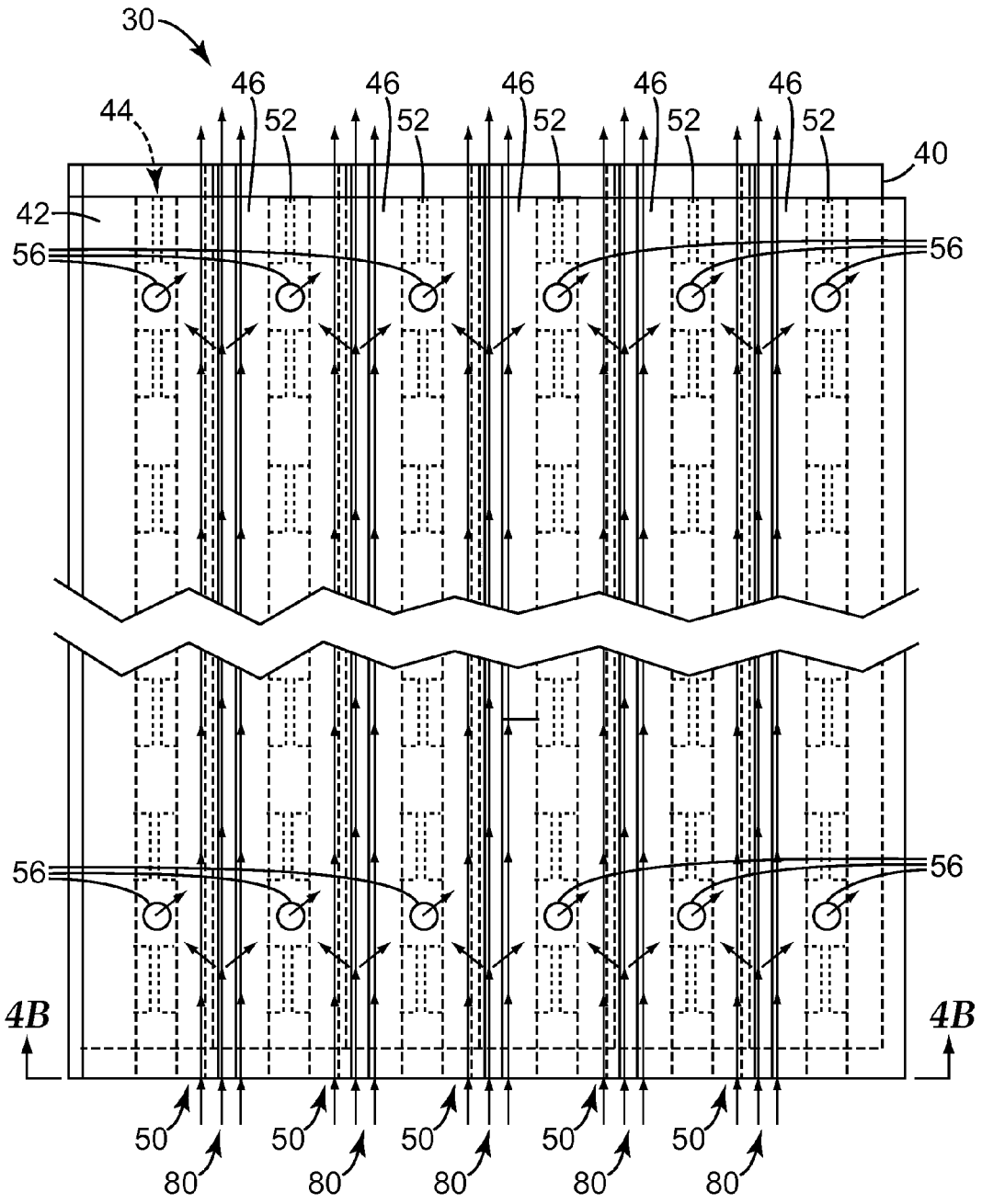
FIG. 4A is a schematic top view of a building construction assembly according to the present disclosure illustrating airflow therethrough.
Figure 4B:
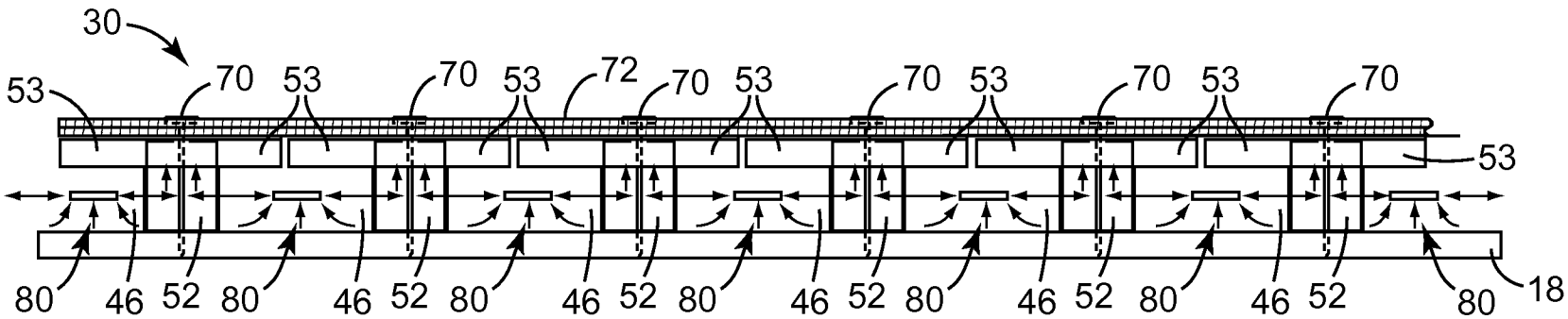
FIG. 4B is a schematic end view of the building construction assembly of FIG. 4A along line 4B-4B.

FIG. 4A is a schematic top view of the building construction assembly 30 according to the present disclosure illustrating airflow therethrough. FIG. 4B is a schematic end view of the building construction assembly 30 illustrated in FIG. 4A taken along line 4B-4B. As is shown, outside air 80, which may comprise soffit air or air from other regions, enters the building construction assembly 30 through the inlets 50 and flows through the airflow channels 46. The air 80 that flows through the airflow channels 46 may be heated by the solar load on the roof as it passes through the airflow channels 46, thus removing heat from the building construction assembly upon exit.

A portion of the air 80 that flows through the airflow channels 46 is diverted into the venting channels 52 via the apertures 54 that connect the airflow channels 46 to the venting channels 52. The air 80 flows from the airflow channels 46 to the venting channels 52 due to the path of least resistance of natural air buoyancy. This occurrence is illustrated by the diagonal arrows from the airflow channels 46 to the venting channels 52 in FIG. 4A, and the horizontal arrows entering the venting channels 52 in FIG. 4B. In some embodiments, the apertures 54 are configured such that the air 80 heated by the solar load is naturally forced or directed to the venting channels 52 due to the temperature difference between the air 80 within the building construction assembly 30 and the air exterior of the building construction assembly 30, for example. The air 80 that enters the venting channels 52 then exits the building construction assembly 30 via the exit orifices 56, as illustrated by the arrows extending from the exit orifices 56 in FIG. 4A and the vertical arrows in the venting channels 52 in FIG. 4B.

A building construction article or assembly 30 having airflow channels 46 in communication with venting channels 52 as described herein facilitates control of airflow through the building construction assembly 30. Without being bound by any particular theory, the thermal management provided by building construction assembly 30 is affected in part by the flow of air through the building construction assembly 30 that may serve to remove heat from the building construction assembly 30 and limit conduction into the roof deck and attic, for example. The size, quantity, and configuration of the apertures 54 may be selected to control the flow of air diverted from airflow channels 46 to venting channel 52. That is, larger or more frequent apertures 54 reduce the resistance through the apertures 54 relative to the resistance of airflow channels 46, thus causing more air 80 to flow through the apertures 54. Such a configuration may be desirable for regions of high thermal loading in which it is desirable to vent air 80 from the building construction assembly 30 frequently. Smaller or less frequent apertures 54 may increase the resistance through the apertures 54 relative to the resistance of airflow channels 46, thus resulting in less air 80 flowing through the apertures 54. Such a configuration may be selected to maintain a desired flow of air through airflow channels 46 even during times of limited solar thermal loading. Ultimately, an exemplary building construction assembly 30 allows air 80 to enter venting channel 52 from airflow channels 46 and exit the building construction assembly 30 through exit orifices 56 without traveling an entire distance to the peak. The exit orifices 56 thus allow air 80 to exit the building construction assembly 30 that may not otherwise reach the roof peak, during times of limited solar thermal load, for example, and allow excess air 80 to exit the building construction assembly after traveling only a short distance, during times of high solar thermal loading, for example. Such a configuration may further allow the airflow channels 46 to have a smaller cross-sectional area than if air 80 were not allowed to travel through the apertures 54, venting channels 52, and exit through the exit orifices 56, and may thus reduce material costs and enhance aesthetic appeal of the building construction assembly 30.

In an exemplary embodiment, exit orifices 56 are circular with a diameter between 0.1 in. and 1 in. and are positioned with a frequency of between every 0.5 sq. ft. and 20 sq. ft. of building construction assembly 30. Exit orifices may also be provided in square, rectangular, irregular, or other suitable shapes. In a region of higher solar thermal loading, an exemplary building construction assembly 30 includes exit orifices 56 having relatively larger diameters, such as between 0.625 in. and 1 in. that are positioned between every 0.5 sq. ft. and every 5 sq. ft. of building construction assembly 30. In a region of lower solar thermal loading, an exemplary building construction assembly 30 includes exit orifices 56 having relatively smaller diameters, such as between 0.15 in. and 0.625 in. that are positioned between every 2 sq. ft. and 20 sq. ft. of building construction assembly 30. Further, an exemplary embodiment of building construction assembly 30 includes apertures 54 that are similar or greater in size and frequency to exit orifices 56. In various exemplary embodiments, the cross-sectional area of airflow channels 46 may be between approximately 0.5 sq. in. and 10 sq. in. or may be approximately 3.75 sq. in. or greater, the cross-section area of venting channels 52 may be between approximately 0.375 sq. in. and 3 sq. in. or may be approximately 1.25 sq. in. or greater, or airflow channels 46 and venting channels 52 may exhibit other suitable cross-sectional areas.

In some exemplary embodiments, a system for a roof includes building construction assemblies having a variety of dimensions. For example, relatively larger and/or more frequent exit orifices 56 and apertures 54 may be used on a southern facing roof slope, and relatively smaller and/or less frequent exit orifices 56 and apertures 54 may be used on a northern facing roof slope. Similarly, a building construction assembly having relatively smaller and/or less frequent exit orifices 56 and apertures 54 may be used in a region of high solar thermal loading, for example, when desired for solar harvesting or other purposes.

In various exemplary embodiments, other suitable sizes, frequencies, and combinations of exit orifices 56, apertures 54, venting channels 52, and airflow channels 46 may be selected.

In some exemplary embodiments, the exit orifices 56 may also serve as inlets that allow air 80 to enter the building construction assembly 30. Whether air enters or exits through exit orifices 56 may depend on the relative pressure difference across the orifices 56. As a result, a portion of air 80 may exit the building construction assembly through a first exit orifice 56 closer to a soffit region, while additional outside air may enter a second exit orifice 56 closer to a peak region and exit after traveling all or a portion of a remaining distance to a peak.

In an exemplary embodiment, air 80 that does not exit the building construction assembly via exit orifices 56 may exit through a ridge vent, such as ridge vent 26 proximate a peak 16, for example. Air 80 exiting through ridge vent 26 may be mixed with other air sources such as air from an attic or unconditioned space, or may exit without being mixed with other air sources. In other exemplary embodiments, air 80 from airflow channels may mix with attic air as it flows through the ridge vent. The ridge vent may be configured to meter air from the attic or unconditioned space, and the flow of air 80 from the airflow channels may draw air from the attic or unconditioned space.

Figure 5A:
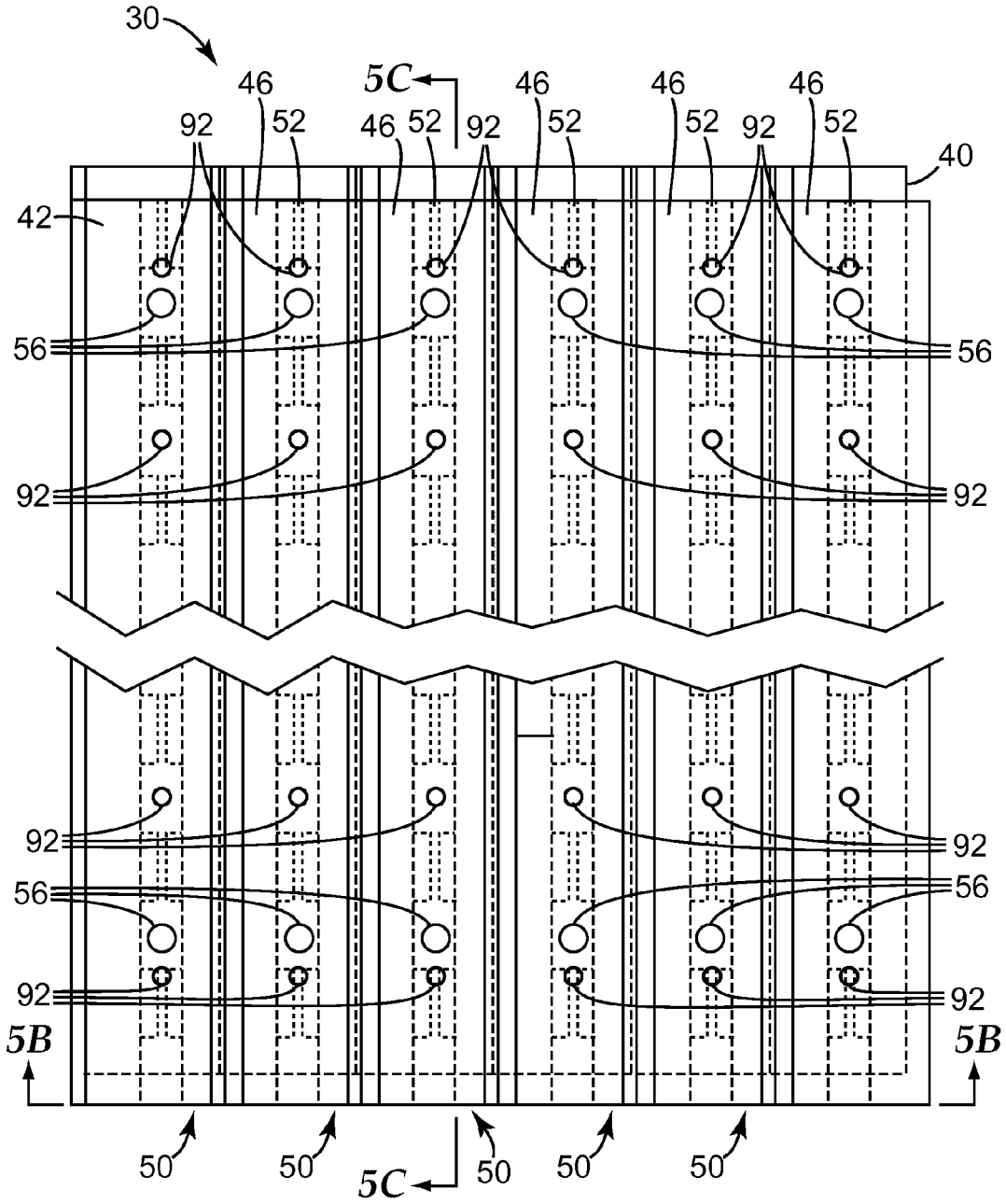
FIG. 5A is a schematic top view of a building construction assembly securable to a roof deck via an adhesive according to an embodiment of the present disclosure.
Figure 5B:
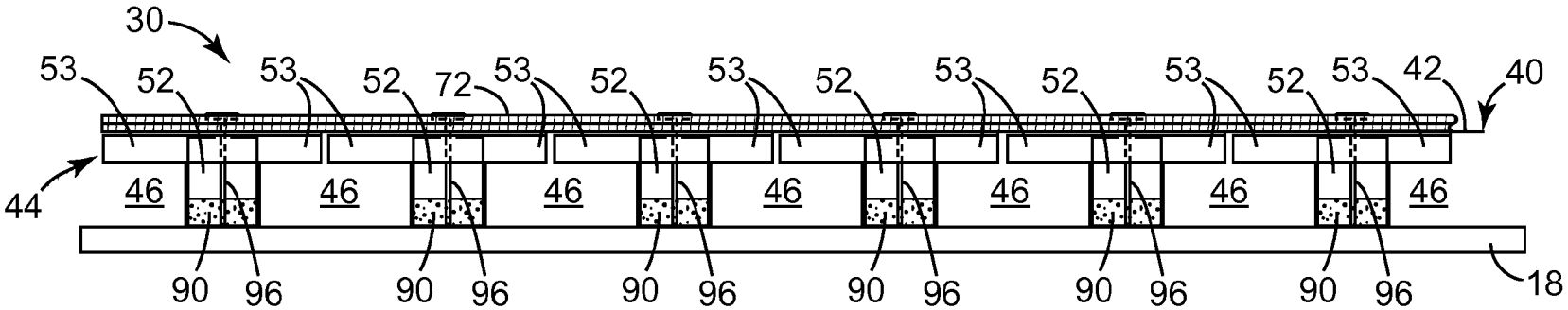
FIG. 5B is a schematic end view of the building construction assembly of FIG. 5A along line 5B-5B.
Figure 5C:
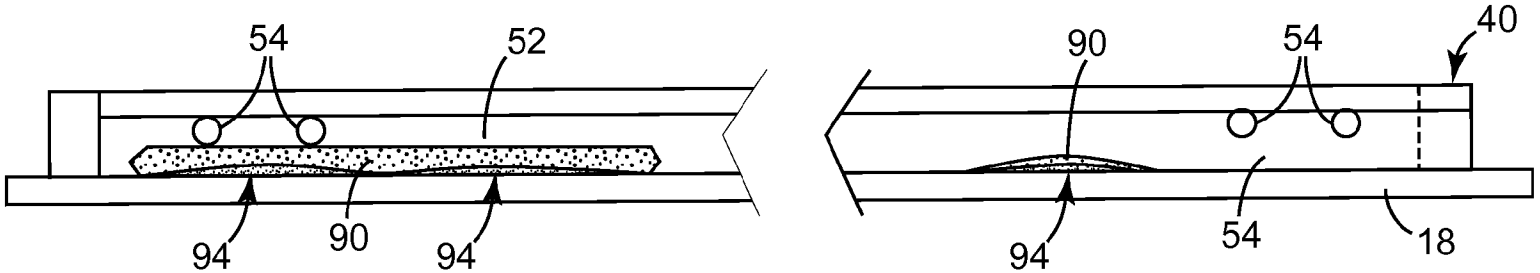
FIG. 5C is a schematic cross-sectional view of the building construction assembly of FIG. 5A along line 5C-5C.

FIG. 5A is a schematic top view of a building construction assembly 30 according to an embodiment of the present disclosure attachable to the roof deck 18 via alternative means. FIG. 5B is a schematic end view of the building construction assembly 30 of FIG. 5A along line 5B-5B, and FIG. 5C is a schematic cross-sectional view of the building construction assembly 30 of FIG. 5A along line 5C-5C. Similar to the embodiment of the building construction assembly 30 described above in FIGS. 2A-2C, the building construction assembly 30 includes a body 40 including a base layer 42 and channel structure 44, the channel structure 44 defining airflow channels 46 and venting channels 52. The channel structure 44 further includes one or more apertures 54 that provide airflow communication between the airflow channels 46 and the venting channels 52. In some embodiments, each venting channel 52 is in airflow communication with two adjacent airflow channels 46. In some embodiments, the apertures 54 are configured to allow warmer air to flow from the airflow channels 46 into the venting channels 52. The channel structure 44 further includes a plurality of exit orifices 56 in airflow communication with the venting channels 52. The exit orifices 56 are configured to allow air in the venting channels 52 to exit the channel structure 44. The airflow through the channel structure 44 of the building construction article 30 shown in FIGS. 5A-5C is similar to the airflow described above with regard to FIGS. 4A and 4B.

The embodiment of the building construction assembly 30 illustrated in FIGS. 5A-5C is configured to be secured to the roof deck 18 with an adhesive material 90 that couples the bottom surfaces of the venting channels 52 to the roof deck 18, as illustrated in FIGS. 5B and 5C. In some embodiments, the building construction assembly 30 includes a plurality of adhesive orifices 92 that extend from the top of the building construction assembly 30, to a bottom or underside of the venting channels 52. When the building construction assembly 30 illustrated in FIGS. 5A-5C is positioned on the roof deck 18, a flowable adhesive 90 is introduced into the adhesive orifices 92 to cause the adhesive 90 to flow through the bottom of the venting channels 52. In some embodiments, the channel structure 44 includes pockets or cavities 94 on the bottom of venting channels 52 to allow the adhesive 90 to flow between the channel structure 44 and roof deck 18. The pockets or cavities 94 may extend along a portion of or the entire length of the underside of the venting channels 52. The adhesive 90 can be applied along the length of the pockets or cavities 94 using an extension rod attached to the adhesive dispenser. In some embodiments, the adhesive 90 is an expandable adhesive that expands between the channel structure 44 and the roof deck 18. An expandable adhesive may provide further rigidity to the building construction assembly 30 thus allowing sufficient rigidity to be provided while minimizing the weight of the building construction assembly 30. An example adhesive material suitable for the adhesive 90 includes, but is not limited to, a polyurethane adhesive foam such as the adhesive foam sold under the trade name 3M POLYSET available from 3M Company, St. Paul, Minn.

In some embodiments, the structural channels 53 can also be filled with the expandable adhesive 90 or other expandable material to provide additional insulation and structural integrity to the installed building construction assembly 30. For example, the structural channels 53 may be connected via sealed tubes (not shown) to allow the expandable adhesive 90 to flow between adjacent structural channels 53.

In other embodiments, other suitable adhesives may be used to secure the building construction assembly 30 to the roof deck 18, such as adhesive provided on a release liner that may be removed upon application of the building construction assembly 30 to the roof deck 18. Alternatively or in addition, other adhesives or adhesive foams may be applied to the roof deck 18 or building construction assembly prior to positioning on the roof deck 18.

After adhering the building construction assembly 30 to the roof deck 18, and the adhesive 90 hardens or cures, one or more additional layers 72 (e.g., shingles, tiles, etc.) may be secured to the top of the building construction assembly 30 via nails 96 or other mechanical fasteners. The nails 96 penetrate the one or more additional layers 72 and the base layer 42, and extend into the venting channels 52. In some embodiments, the nails 96 penetrate only into the adhesive 90 in the venting channels 52, but not into the roof deck 18. In this way, thermal bridging from the solar load on the roof into the roof deck 18 through the nails 96 is prevented. Rather, the adhesive 90 operates as a thermal sink for the solar load thermally transmitted through the nails 96.

As discussed above, the roofing system of the present disclosure allows air within the venting channels 52 to be vented to the outside through the exit orifices 56. In order to prevent liquid (e.g., rain and snow) and external debris (e.g., leaves, dirt, etc.) from entering the building construction assembly 30 through the exit orifices, an exit channel may be provided adjacent to at least some of the exit orifices that is configured to allow air to exit the building construction assembly 30 while covering the shielding the exit orifices 56 from external moisture and debris.

Figure 6:
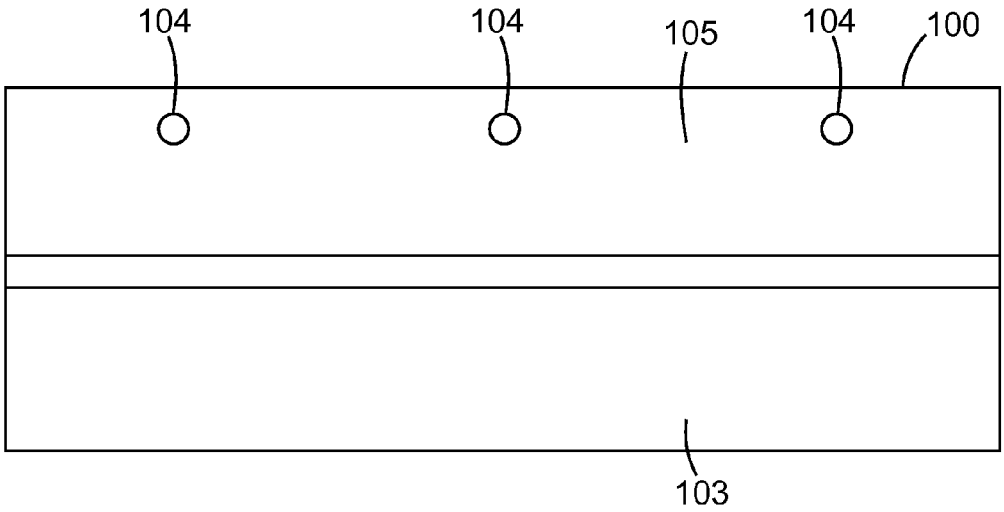
FIG. 6 is a schematic top view of a first shingle assembly portion configured for use with the building construction assembly of the present disclosure.
Figure 7:
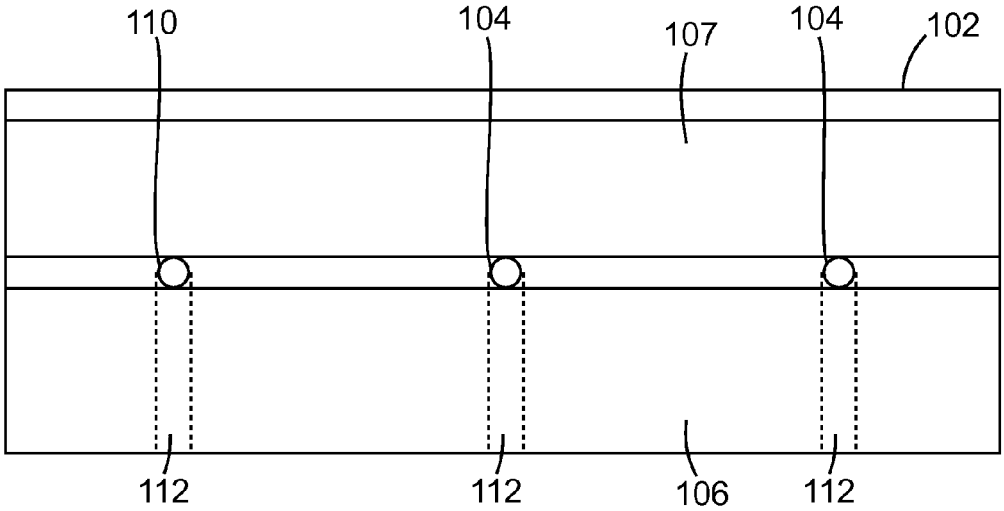
FIG. 7 is a schematic top view of a second shingle assembly portion configured for use with the building construction assembly of the present disclosure.

For example, FIGS. 6 and 7 illustrate portions of a shingle assembly that is configured to provide an exit channel for the exit orifices 56. Particularly, FIG. 6 illustrates a first shingle assembly portion 100 and FIG. 7 illustrates a second shingle assembly portion 102 that are configured to mechanically couple to provide an exit channel. The first shingle assembly portion 100 includes a body portion 103 and a plurality of apertures 104 on an underlaying portion 105. The body portion 103 may resemble conventional asphalt shingles, tiles, or other rooftop coverings. For example, the body portion 103 can include a layer or layers of roofing granules presented thereon, such as, for example, those described in U.S. Pat. Nos. 7,455,899, 7,648,755, and 7,919,170, each of which is incorporated by reference herein in its entirety.

The apertures 104 on the underlaying portion 105 are configured to interface and overlap with the exit orifices 56 on the building construction assembly 30. In some embodiments, the apertures 104 on the first shingle assembly portion 100 are substantially the same size as the exit orifices 56. When positioned with the apertures 104 over the exit orifices 56, the first shingle assembly portion 100 can be attached to the building construction assembly 30 using nails or other fastening mechanisms.

The second shingle assembly portion 102 includes body portion 106 and an underlaying portion 107. The body portion 106 includes a plurality of orifices 110 and a plurality of exit channels 112 extending from the orifices 110. The plurality of channels 112 are formed into the underside of the body portion 106. The body portion 106 may resemble conventional asphalt shingles, tiles, or other rooftop coverings, similar to the body portion 103 above.

The second shingle assembly portion 102 is positioned over the first shingle assembly portion 100 such that the body portion 106 of the second shingle assembly 102 is disposed over the underlaying portion 105 of the first shingle assembly portion 100. When properly aligned, the orifices 110 on the second shingle assembly 102 couple with the apertures 104 on the first shingle assembly 100. This provides airflow communication between the exit orifices 56, the apertures 104 on the first shingle assembly 100, and the orifices 110 and exit channels 112 on the second shingle assembly 102. When positioned as described, the second shingle assembly 102 can be attached to the building construction assembly 30 using nails or other fastening mechanisms. Additional layers, such as conventional shingles or other roof coverings, may then be attached to the underlaying portion 107 of the second shingle assembly 102. The body portions 103 and 106, combined with the conventional shingles or other roof coverings, can thus provide the appearance of a conventional roof covering.

Figure 8A:
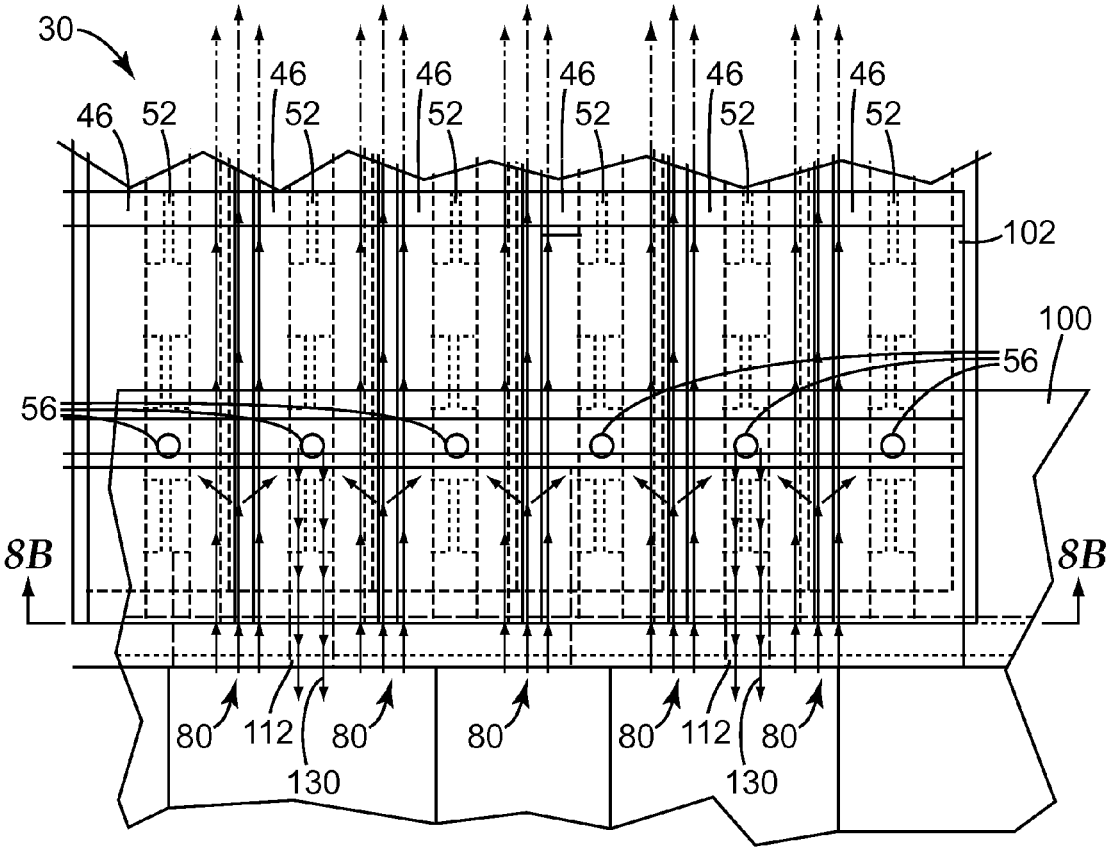
FIG. 8A is a schematic top view of a building construction assembly according to the present disclosure including the shingle assembly portions of FIGS. 6 and 7 coupled thereto.
Figure 8B:
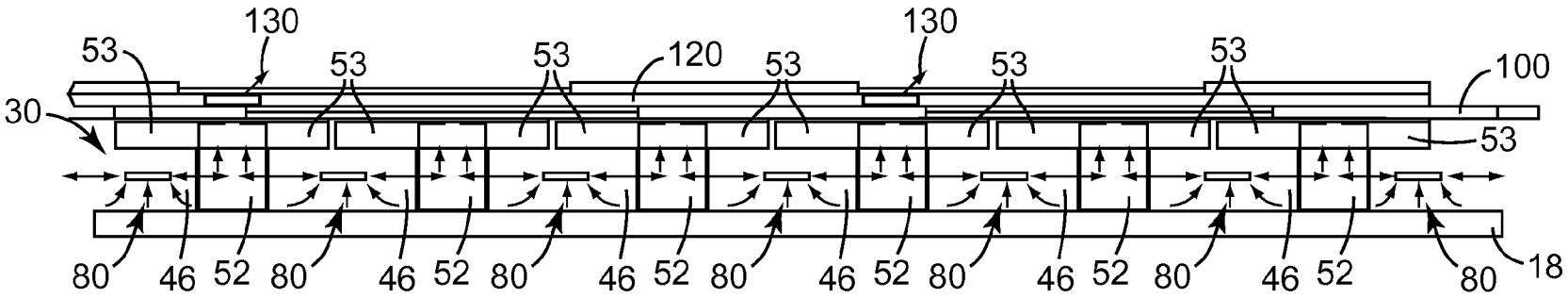
FIG. 8B is a schematic end view of the building construction assembly of FIG. 8A along line 8B-8B.
Figure 9:
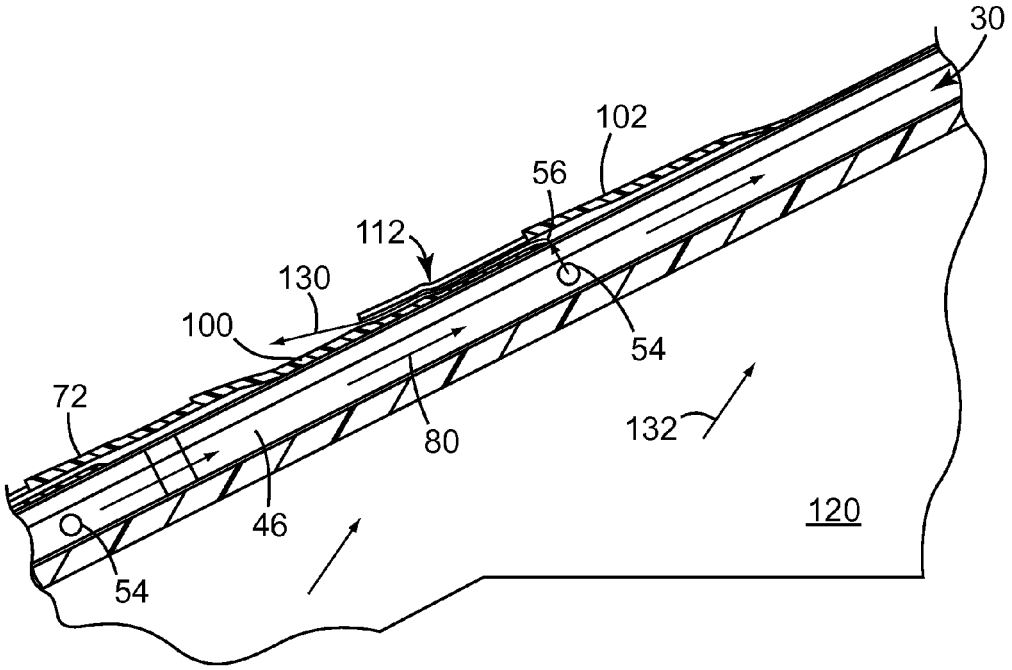
FIG. 9 is a schematic cross-sectional view of the building construction assembly of FIGS. 8A and 8B mounted on a roof deck.

To illustrate the shingle assembly of FIGS. 6 and 7 in use, FIG. 8A is a schematic top view of the building construction assembly 30 of FIGS. 5A-5C including the shingle assembly portions 100 and 102 coupled thereto. FIG. 8B is a schematic end view of the building construction assembly 30 of FIG. 8A along line 8B-8B, mounted on a roof deck 18. FIG. 9 is a schematic cross-sectional view of the building construction assembly 30 of FIGS. 8A and 8B mounted on a roof deck 18, and showing airflow in the building construction assembly 30 and the unconditioned space 120 below the roof deck 18.

As is shown, the airflow of the outside air 80 that is diverted into the venting channels 52 exits the building construction assembly 30 via the exit apertures 56 and into the exit channel 112 between the first shingle assembly 100 and the second shingle assembly 102. The exit channel 112 is directed such that the exiting airflow 130 is directed in the direction of the soffit 14. This configuration prevents the ingress of moisture and debris into the building construction assembly 30. In the embodiment illustrated, fewer than all of the exit apertures 56 in the building construction assembly 30 are in airflow communication with exit channels 112. In other embodiments, all of the exit apertures 56 are in airflow communication with exit channels 112. The direction of airflow 132 of elevated temperature air in the unconditioned space 120 is toward the ridge vent 26 due to the natural buoyancy of warm air.

Figure 10:
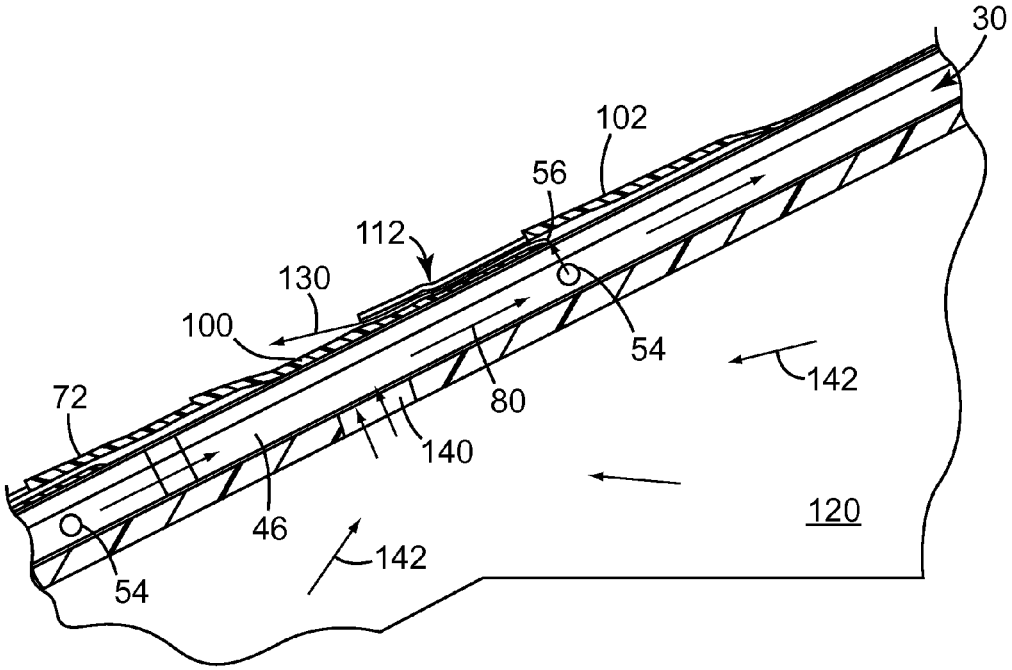
FIG. 10 is a schematic cross-sectional view of the building construction assembly of FIGS. 8A and 8B mounted on a roof deck of a building including airflow control in an unconditioned space.

FIG. 10 is a schematic cross-sectional view of the building construction assembly 30 of FIGS. 8A and 8B mounted on a roof deck 18 with airflow control in the unconditioned space 120. In this embodiment, one or more openings 140 is provided in the roof deck 18, and airflow communication is provided between the unconditioned space 120 and the airflow channels 46 of the building construction assembly 30 via the one or more openings 140. The pressure differential between the airflow channels 46 and the unconditioned space 120 causes the air 142 in the unconditioned space 120 to flow into the airflow channels 46 via the openings 140.

In some cases, it may be desirable to control the airflow in the unconditioned space 120. In some embodiments, the one or more blowers or fans, such as variable speed/high pressure fans, can be used to effect movement of air in the unconditioned space 120. The fans may be configured to push air through the unconditioned space 120, for example from the soffit 14 to the peak 16. Example systems for managing airflow in an unconditioned space 120 are described in U.S. Patent App. No. 61/494,266, titled "System and Method for Management of a Roof," which is hereby incorporated by reference in its entirety.

Figure 11:
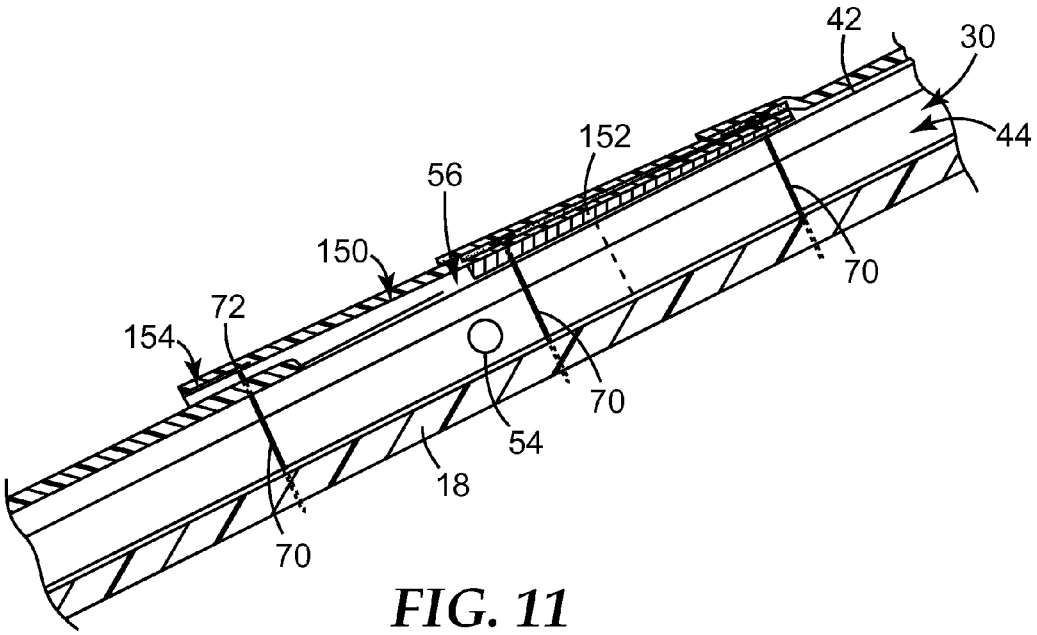
FIG. 11 is a schematic cross-sectional view of a building construction assembly according to the present disclosure including integral exit channels mounted on a roof deck.

FIG. 11 is a schematic cross-sectional view of a building construction assembly 30 according to an alternative embodiment of the present disclosure. In this embodiment, an exit channel 150 is formed integrally with the building construction assembly 30. The building construction assembly 30 includes an angled structure 152 (i.e., angled with respect to the base layer 42) adjacent to each exit aperture 56 that provides the structure defining the exit channel 150. The building construction assembly 30 of FIG. 11 may be secured to the roof deck 18 via nails 70 that penetrate through building construction assembly 30 and into the roof deck 18. Alternatively, the building construction assembly 30 can be secured to the roof deck 18 via an adhesive as described above. One or more additional layers 72 can be secured to the top surface of the building construction assembly 30. For example, the additional layers 72 may include asphalt shingles, concrete, slate, or clay tiles, metal tile or shingles, standing seam metal roofs, or other roof protective coverings. The additional layers 72 may also (or alternatively) include one or more optical layers as described above. In some embodiments, the top surface of the exit channel 150 includes an adhesive strip 154 that facilitates attachment of the one or more additional layers 72 to the top of the exit channel 150. In some embodiments, the adhesive strip 154 comprises an asphalt-based adhesive.

Figure 12:
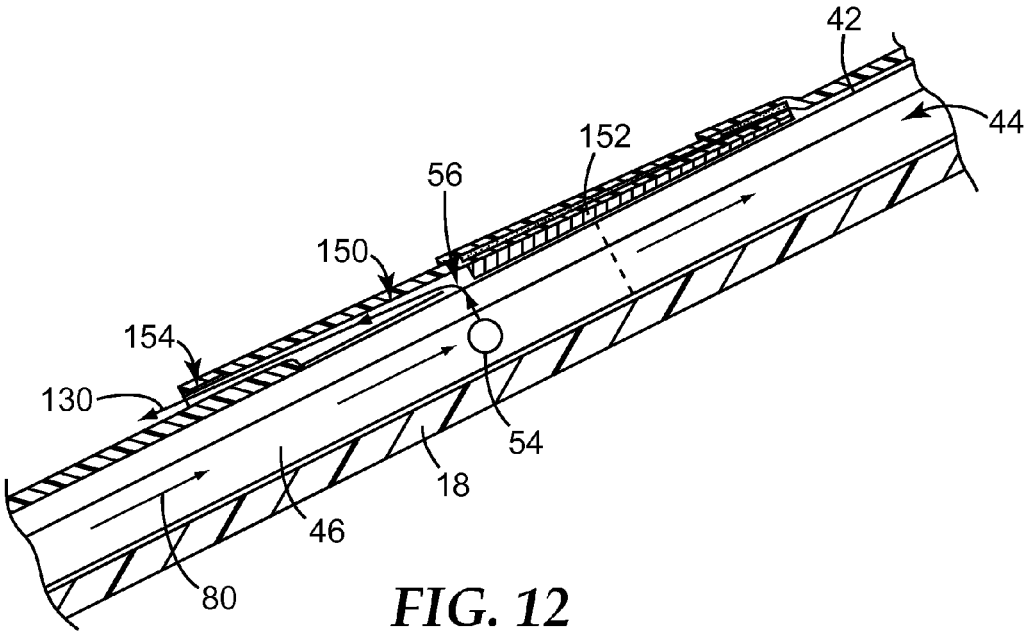
FIG. 12 is a schematic cross-sectional view of the building construction assembly of FIG. 11 illustrating airflow through the building construction assembly.

FIG. 12 illustrates the airflow through the building construction assembly 30 of FIG. 11, including the air 80 through the airflow channels 46, into apertures 54, and exiting through the integral exit channel 150.

Figure 13:
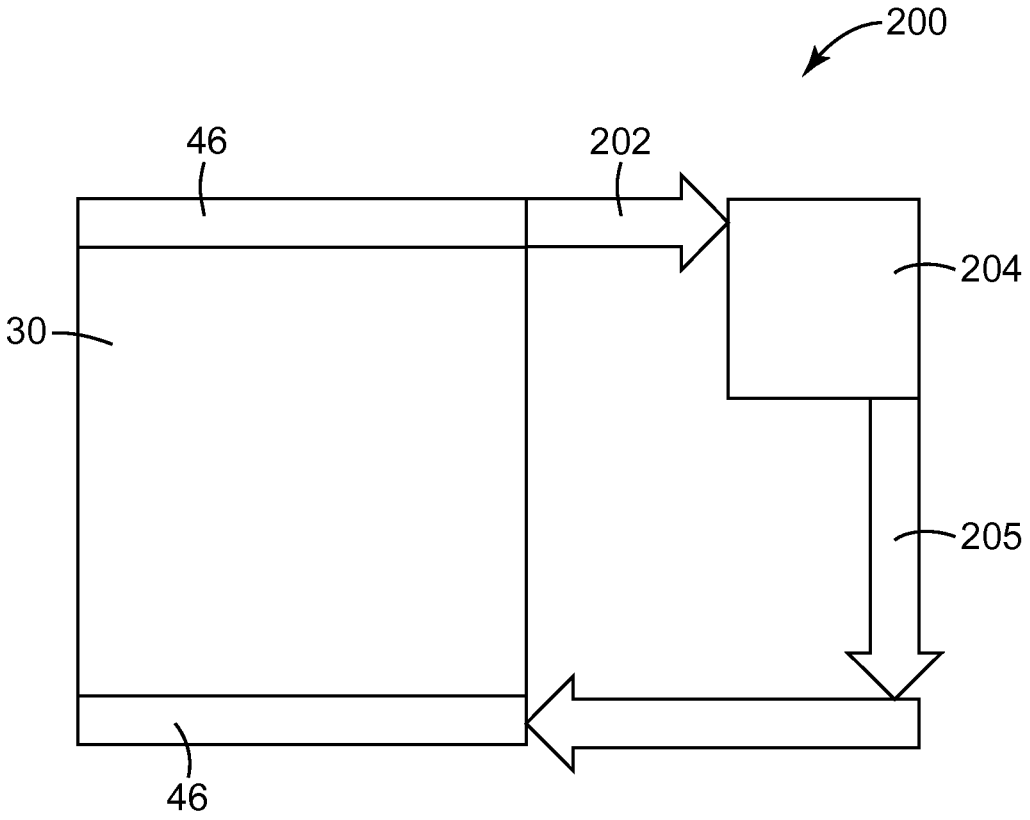
FIG. 13 is a schematic view of a system including a building construction article according to the present disclosure for harvesting and storing solar energy.

FIG. 13 is a schematic view of a system 200 including a building construction assembly 30 with airflow channels 46 configured for solar harvesting of low grade heat according to an embodiment of the present disclosure. One or more additional air channels 202 supply heated air from the building construction assembly 30 for building heating, or drying, or other uses. An optional thermal storage unit 204 can store harvested solar energy for later use (e.g., heating of an associated building or structure at night). For example, the one or more air channels 206 connected to the thermal storage unit 134 can return the harvested solar energy to the building construction assembly 30. The building construction assembly 30 can be used, for example, as building construction articles such as roofing, vertical walls, and sloped walls.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The invention claimed is:

1. A building construction assembly for installation on a roof deck, the building construction assembly comprising:

a base layer; and a channel structure coupled to the base layer and defining a plurality of channels, the plurality of channels including a first airflow channel and second airflow channel extending in parallel through the channel structure, the plurality of channels further including a venting channel between the first and second airflow channels and the base layer, the channel structure defining one or more apertures between the venting channel and each of the first and second airflow channels configured to allow airflow from the first and second airflow channels into the venting channel, wherein the base layer defines one or more exit orifices in airflow communication with the venting channel and configured such that air in the venting channel exits the building construction assembly through the one or more exit orifices;

wherein the channel structure defines one or more roof ventilation orifices on a side of the channel structure opposite base layer, the one or more roof ventilation orifices each configured for airflow communication with an unconditioned space below the roof deck.

2. The building construction assembly of claim 1, and further comprising one or more exit channels each in airflow communication with one of the one or more exit orifices.

3. The building construction assembly of claim 2, and further comprising a shingle assembly disposed on the base layer on a side opposite the channel assembly, the shingle assembly defining the one or more exit channels.

4. The building construction assembly of claim 1, and further comprising:

a radiant barrier film on one or more surfaces of the channel structure.

5. The building construction assembly of claim 1, wherein the building construction assembly is fastenable to the roof deck with a plurality of fasteners extending through at least a portion of the channel structure and into the roof deck.

6. The building construction assembly of claim 1, wherein the building construction assembly is fastenable to the roof deck with an expandable adhesive.

7. The building construction assembly of claim 6, wherein one or more additional layers are fastenable to the base layer on a side opposite the channel structure via fasteners extending through the additional layers and building construction assembly and into the expandable adhesive.

8. The building construction assembly of claim 1, wherein the building construction assembly has a weight of between about 0.50 $lbs/ft^2$ and about 1.25 $lbs/ft^2$.

9. The building construction assembly of claim 1, wherein the building construction assembly has a short-term structural load capacity of at least 200 pounds per 4 inch by 4 inch area.

10. The building construction assembly of claim 1, wherein the building construction assembly is transportable in roll form.

11. The building construction assembly of claim 1, wherein the channel structure further includes materials selected from the group consisting of intumescent materials and phase change materials (PCMs).

12. The building construction assembly of claim 1, wherein the channel structure further includes one or more structural channels above the first and second airflow channels and adjacent the venting channel.

13. The building construction assembly of claim 12, further comprising a structural material having cavities and positioned in the one or more structural channels, wherein one or more materials selected from the group consisting of intumescent materials, PCMs, or thermal management materials are positioned in the cavities of the structural material.

14. A system for a roof, the system comprising:

a plurality of building construction assemblies, each building construction assembly comprising:

a base layer; and a channel structure coupled to the base layer and defining a plurality of channels, the plurality of channels including a first airflow channel and second airflow channel extending in parallel through the channel structure, the plurality of channels further including a venting channel between the first and second airflow channels and the base layer, the channel structure defining one or more apertures between the venting channel and each of the first and second airflow channels configured to allow airflow from the first and second airflow channels into the venting channel, wherein the base layer defines one or more exit orifices in airflow communication with the venting channel and configured such that air in the venting channel exits the building construction assembly through the one or more exit orifices, wherein the plurality of building construction assemblies are adjacently arranged on a roof deck such that the plurality of channels in the adjacently arranged building construction assemblies extend from a soffit region of the roof to a peak of the roof; and wherein the channel structure of each building construction assembly defines one or more roof ventilation orifices on a side of the channel structure opposite base layer, the one or more roof ventilation orifices each configured for airflow communication with an unconditioned space below the roof deck.

15. The system of claim 14, and further comprising one or more exit channels each in airflow communication with one of the one or more exit orifices.

16. The system of claim 15, and further comprising:

a shingle assembly disposed on the base layer on a side opposite the channel assembly, the shingle assembly defining the one or more exit channels.

17. The system of claim 14, and further comprising:

a radiant barrier film on one or more surfaces of the channel structure of each of the building construction assemblies.

18. The system of claim 14, wherein each building construction assembly is fastenable to the roof deck with a plurality of fasteners extending through at least a portion of the channel structure and into the roof deck.

19. The system of claim 14, wherein each building construction assembly is fastenable to the roof deck with an expandable adhesive.

20. The system of claim 19, wherein one or more additional layers are fastenable to the base layer of each building construction assembly on a side opposite the channel structure via fasteners extending through the additional layers and building construction assembly and into the expandable adhesive.

21. The system of claim 14, and further comprising:

shingles coupled to the base layer of each building construction assembly on a side opposite the channel structure.

22. The system of claim 14, and further comprising:

a collection manifold in airflow communication with the plurality of channels for solar harvesting of low grade heat.

23. The system of claim 22, and further comprising:

a solar thermal unit for storage or transfer of the low grade heat.

24. A building construction assembly for installation on a roof deck, the building construction assembly comprising:

a base layer; and a channel structure coupled to the base layer and defining a plurality of channels, the plurality of channels including a first airflow channel and second airflow channel extending in parallel through the channel structure, the plurality of channels further including a venting channel between the first and second airflow channels and the base layer, the channel structure defining one or more apertures between the venting channel and each of the first and second airflow channels configured to allow airflow from the first and second airflow channels into the venting channel, wherein the base layer defines one or more exit orifices in airflow communication with the venting channel and configured such that air in the venting channel exits the building construction assembly through the one or more exit orifices, wherein the channel structure further includes one or more structural channels above the first and second airflow channels and adjacent the venting channel; and a structural material having cavities and positioned in the one or more structural channels, wherein one or more materials selected from the group consisting of intumescent materials, PCMs, or thermal management materials are positioned in the cavities of the structural material.

* * * * *